US011215387B2

(12) United States Patent
Ku et al.

(10) Patent No.: US 11,215,387 B2
(45) Date of Patent: Jan. 4, 2022

(54) ACCUMULATOR

(71) Applicant: LG ELECTRONICS INC., Seoul (KR)

(72) Inventors: Sejin Ku, Seoul (KR); Hyungjin Park, Seoul (KR); Sangmyung Byun, Seoul (KR); Gyeongsu Jin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/840,089

(22) Filed: Apr. 3, 2020

(65) Prior Publication Data

US 2020/0232692 A1 Jul. 23, 2020

Related U.S. Application Data

(62) Division of application No. 15/831,186, filed on Dec. 4, 2017, now Pat. No. 10,648,717.

(30) Foreign Application Priority Data

Mar. 17, 2017 (KR) ..... 10-2017-0033627
Jun. 21, 2017 (KR) ..... 10-2017-0078522

(51) Int. Cl.
*F25B 43/00* (2006.01)
*F25B 39/02* (2006.01)

(52) U.S. Cl.
CPC ..... *F25B 43/006* (2013.01); *F25B 39/02* (2013.01)

(58) Field of Classification Search
None
See application file for complete search history.

(56) References Cited

U.S. PATENT DOCUMENTS

| | | | | |
|---|---|---|---|---|
| 4,009,596 | A | 3/1977 | Morse | |
| 4,182,136 | A | 1/1980 | Morse | |
| 4,209,997 | A | 7/1980 | Hodits, Jr. et al. | |
| 6,708,519 | B1 | 3/2004 | Monk | F25B 43/006 62/498 |
| 2017/0167487 | A1* | 6/2017 | Nakai | F04C 29/0057 |

FOREIGN PATENT DOCUMENTS

| | | | |
|---|---|---|---|
| CN | 1715662 | A | 1/2006 |
| CN | 1880767 | A | 12/2006 |
| CN | 101995123 | A | 3/2011 |
| CN | 203272134 | U | 11/2013 |
| CN | 204388254 | U | 6/2015 |
| CN | 105042958 | A | 11/2015 |
| CN | 105042960 | A | 11/2015 |
| CN | 105899893 | A | 8/2016 |
| CN | 205503459 | U | 8/2016 |

(Continued)

*Primary Examiner* — Elizabeth J Martin
(74) *Attorney, Agent, or Firm* — Dentons US LLP

(57) ABSTRACT

An accumulator connected to a compressor, the accumulator including a case that forms a space in which liquid refrigerant and gaseous refrigerant are accommodated, a suction pipe which is connected to the case, and at least one connection pipe which connects a side surface of the case and a suction side of the compressor, whereby a space between a side surface of the compressor and a side surface of the accumulator is less than a length of a portion of the connection pipe from the side surface of the compressor to the side surface of the accumulator.

18 Claims, 9 Drawing Sheets

(56) References Cited

FOREIGN PATENT DOCUMENTS

| | | | |
|---|---|---|---|
| JP | 02-128060 | U | 10/1990 |
| JP | H04-350479 | A | 12/1992 |
| JP | H07-189967 | A | 7/1995 |
| JP | 2010-286217 | A | 12/2010 |
| JP | 2014-092078 | A | 5/2014 |
| JP | 2015-105792 | A | 6/2015 |
| KR | 10-2011-0095155 | A | 8/2011 |

* cited by examiner

ACCUMULATOR

CROSS-REFERENCE TO RELATED APPLICATIONS

This application is a Divisional of U.S. patent application Ser. No. 15/831,186, filed Dec. 4, 2017, now allowed, which claims priority under 35 U.S.C. § 119 and 35 U.S.C. § 365 to Korean Patent Application Nos. 10-2017-0033627 (filed on Mar. 17, 2017) and 10-2017-0078522 (filed on Jun. 21, 2017), which are hereby incorporated by reference in their entirety.

BACKGROUND

The present invention relates to an accumulator configured to be connected to a compressor.

In general, a compressor is a device that receives power from a power generating device, such as an electric motor and a turbine, and compresses air, refrigerant or various other working gasses to increase the pressure thereof. Compressors are commonly used with household and industrial appliances, such as with refrigerators and air conditioners. Compressors may be categorized as reciprocating, rotary, and scroll type.

The reciprocating compressor generally compresses refrigerant while a piston linearly reciprocates in a cylinder so as to form a compression space in which a working gas is suctioned and discharged between the piston and the cylinder.

The rotary compressor has a compression space in which a working gas is suctioned and discharged. The compression space is generally formed between a roller which is eccentrically rotated and a cylinder. The roller is eccentrically rotated along an inner wall of the cylinder to compress the refrigerant.

The scroll compressor has a compression space in which a working gas is suctioned and discharged. The compression space is formed between an orbiting scroll and a fixed scroll. The orbiting scroll rotates about the fixed scroll to compress the refrigerant.

Each of the compressors described above includes an accumulator for receiving a low-temperature and low-pressure gaseous refrigerant. The accumulator is a device for separating liquid refrigerant from the refrigerant introduced from a heat exchanger (e.g., evaporator) and discharging only gaseous refrigerant to the compressor.

Korean Publication No. 10-2011-0095155 discloses a known structure for an accumulator. The accumulator described therein is a structure in which a connection pipe extending from a bottom surface of the accumulator is connected to an outside of a compressor while bending.

However, because the connection pipe must extend from the bottom surface of the accumulator and be connected to an outside of the compressor, the accumulator must be installed above the ground. This is problematic because it increases the overall height of the product, causes additional vibration on the accumulator due to vibration being generated in the compressor, and generates noise.

The present application provides an improved accumulator design and is directed to solving the above described problems.

SUMMARY

The present invention has been made in order to solve at least the above problems associated with the conventional technology.

According to an embodiment of the invention, there may be provided an accumulator including: a case that forms a space in which liquid refrigerant and gaseous refrigerant are accommodated; a suction pipe that is connected to the case; and at least one connection pipe that connects a side surface of the case and a suction side of the compressor to each other.

The gap between the side surface of the compressor and the side surface of the accumulator may be configured to be shorter than the length of a portion of the connection pipe from the side surface of the compressor to the side surface of the accumulator.

The case may include a recessed portion that is partially recessed inward, and one end of the connection pipe may be connected to the suction portion of the compressor, and the other end thereof may be coupled to the recessed portion.

Therefore, a working space for joining the connection pipe to the outside of the compressor can be provided while reducing a design height of the accumulator. In addition, due to such a structure, since a vertical center of the compressor is located proximate to a vertical center of the accumulator, vibration of the accumulator due to vibration being transferred from the compressor to the accumulator can be reduced or minimized.

According to an embodiment of the invention, the case may include a body of which an upper portion and a lower portion are opened and in which a space is formed, an upper cap which covers an upper portion of the body and to which the suction pipe is coupled, and a lower cap which covers the lower portion of the body and in which the recessed portion is formed.

The recessed portion may include a stepped surface that is spaced apart from an outer peripheral surface of the lower cap toward the center of the lower cap by a predetermined distance and the connection pipe may be inserted into the stepped surface. A through hole through which the connection pipe passes is formed on the stepped surface. At this time, the center of the through hole may be positioned below the line bisecting the stepped surface vertically so that the liquid refrigerant stored in the lower cap can be more easily vaporized by the heat of the refrigerant flowing through the connection pipe.

In addition, according to an embodiment of the invention, the connection pipe may include a first connection pipe and a second connection pipe which are spaced apart from each other, and a first through hole through which the first connection pipe passes and a second through hole through which the second connection pipe passes may be formed on the stepped surface.

At this time, in the stepped surface, the first through hole may be positioned above a line bisecting the stepped surface vertically and the second through hole may be positioned below a line bisecting the stepped surface vertically. Therefore, the accumulator according to an embodiment of the invention can be applied not only to a single rotary compressor having one cylinder but also to a twin rotary compressor having two cylinders into which refrigerant is introduced, respectively. According to an embodiment of the invention, the recessed portion may further include an inclined surface which is inclined upward from the upper end of the stepped surface and extends in a direction away from the center of the lower cap.

According to an embodiment of the invention, the connection pipe may include a first pipe portion which extends horizontally and includes a horizontal portion passing through the stepped surface and a bent portion bent upward at an end portion of the horizontal portion, and a second pipe portion which extending upward from the end portion of the bent portion, in which the center of the second pipe portion and the center of the body may be coincident with each other.

According to an embodiment of the invention, the first pipe portion is made of a copper or a copper alloy material, and the second pipe portion is made of a steel or steel alloy material, and thus pipe manufacturing cost can be reduced.

According to an embodiment of the invention, the radius of the body is understood to be a sum of a distance L1 from the outer peripheral surface of the body to the stepped surface and a distance L2 from the center of the body to the stepped surface and L1 may be larger than L2.

According to an embodiment of the invention, the distance from the stepped surface to the central axis of the body may be larger than the radius of the connection pipe.

According to an embodiment of the invention, the distance from the stepped surface to the central axis of the body may be larger than the diameter of the connection pipe.

According to an embodiment of the invention, at least a portion of the stepped surface may be rounded in the peripheral direction of the body.

In addition, according to another an embodiment of the invention, there is provided an accumulator including: a case that defines a space in which liquid refrigerant and gaseous refrigerant are accommodated; a suction pipe that is connected to an upper portion of the case; a recessed portion that is formed by a portion of the case being recessed toward an inner side thereof, and a connection pipe that has one end which is connected to a suction portion of the compressor and the other end which is coupled to the recessed portion.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE EMBODIMENTS

Figure 1:
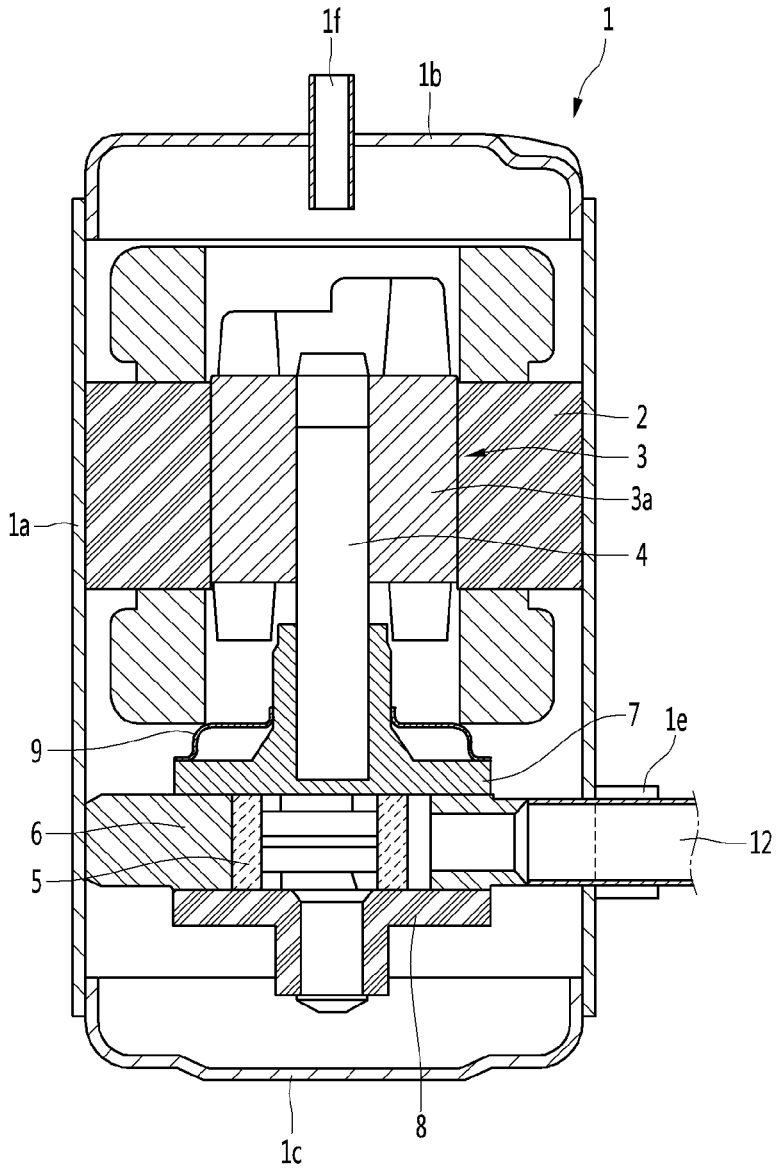
FIG. 1 is a longitudinal sectional view illustrating a configuration of a compressor according to a first embodiment of the invention.

Reference will now be made in detail to the embodiments of the disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

In the following description, the same elements will be designated by the same reference numerals although they are shown in different drawings. Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

In the compressor described below, as an example, a structure for a rotary compressor is disclosed. However, the accumulator of the present invention is not limited to the rotary compressor but can be applied to various compressors such as a reciprocating compressor and a scroll compressor.

FIG. 1 is a longitudinal sectional view illustrating a configuration of a compressor according to a first embodiment of the present invention.

With reference to FIG. 1, the compressor 1 may be a rotary compressor.

Specifically, the compressor 1 may include a case 1*a* which forms an inner space, a top cover 1*b* coupled to an upper side of the case 1*a*, and a bottom cover 1*b* which is coupled to a lower side of the case 1*a*.

The case 1*a* may be formed in a cylindrical shape with an upper portion and a lower portion being opened, but it is not limited to any particular shape. The case 1*a* may include a guide portion 1*e* to which the connection pipe 12 of the accumulator may be connected.

The connection pipe 12 may be inserted into the guide portion 1*e* so that refrigerant can be supplied to the suction portion of the compressor 1 from the accumulator.

The top cover 1*b* may be coupled to cover the opened upper surface of the case 1*a*.

The top cover 1*b* may include a discharge pipe 1*f* through which the refrigerant compressed in a cylinder 6 of the compressor 1 is discharged. For example, the discharge pipe 1*f* may pass through the center of the top cover 1*b*.

A motor may be provided in the case 1*a*. The motor may include a stator 2 which generates a magnetic force by an applied power and a compression mechanism portion 3. The compression mechanism portion 3 may compresses the refrigerant by an induced electromotive force generated through interaction with the stator 2.

The compression mechanism portion 3 may include a rotor 3*a* which is provided in the stator 2 and rotates. The stator 2 and the rotor 3*a* may be understood as components of the motor. The compression mechanism portion 3 may further include a rotation shaft 4 coupled to the rotor 3*a* and rotated according to rotation of the rotor 3*a*.

The compressor 1 may further include a roller 5 which is eccentrically coupled to a lower portion of the rotary shaft 4. The roller 5 may be rotated with a predetermined eccentric trajectory according to the rotation of the rotary shaft 4.

The compressor 1 may further include a cylinder 6 in which the roller 5 is accommodated.

The cylinder 6 may form a suction portion for introducing the refrigerant and a compression space for compressing the refrigerant suctioned in the suction portion. The suction portion of the cylinder 6 may be connected to the connection pipe 12 of the accumulator to receive the refrigerant.

The compressor 1 may further include a vane (not illustrated) to separate a suction chamber and a compression chamber from each other while reciprocating in a slot formed in the cylinder 6 according to the rotation of the roller 5.

In addition, the compressor 1 may include a discharge portion (not illustrated) to discharge the compressed refrigerant in the compression space of the cylinder 6 and a muffler 9 which is provided on an upper portion of the discharge portion and reduces the discharge noise of the refrigerant.

The discharge portion is a passage through which the refrigerant compressed in the compression chamber is discharged when the pressure in the compression chamber of the cylinder 6 becomes the discharge pressure or more. A discharge valve that controls discharge of the compressed refrigerant may be provided at one side of the discharge portion.

The discharge valve may be disposed on a main bearing 7 which is positioned on an upper side of the cylinder 6. Accordingly, the refrigerant discharged through the discharge portion can be introduced into the muffler 9 positioned at the upper side of the main bearing 7.

The compressor 1 may include a main bearing 7 and a sub-bearing 8 which are provided at the upper portion and the lower portion of the cylinder 6 to support the cylinder 6.

The main bearing 7 and the sub-bearing 8 may be provided in a substantial disc shape (not limited thereto) and thus can support the upper side and the lower side of the cylinder 6, respectively.

The main bearing 7 may be provided at the upper side of the cylinder 6 and thus can distribute the compression force of the refrigerant generated in the cylinder 6 or the force generated by the motor to the case 1*a* side.

The sub-bearing 8 may be provided at the lower side of the cylinder 6 and thus can distribute the compressive force of the refrigerant generated in the cylinder 6 or the force generated by the motor to the case 1*a* side.

The operation according to the compressor configuration is described below.

When the rotary shaft 4 rotates, the roller 5 rotates and revolves along the inner circumferential surface of the cylinder 6 while drawing a predetermined eccentric trajectory. The refrigerant stored in the accumulator flows into the compression chamber of the cylinder 6 through the connection pipe 12 and the refrigerant is compressed in the compression chamber by the rotating roller 5.

Subsequently, when the pressure in the compression chamber is greater than or equal to the discharge pressure, the discharge valve provided at one side of the discharge portion opens, and the compressed refrigerant discharges from the discharge portion through the opened discharge valve. Then, the discharged compressed refrigerant repeats a series of steps including a discharging step which is discharged through a discharge pipe if to a refrigeration cycle apparatus (not illustrated) and a suction step that is suctioned back into the compression chamber of the cylinder 6 through the accumulator.

Hereinafter, the accumulator according to a first embodiment of the present invention will be described with reference to the drawings.

Figure 2:
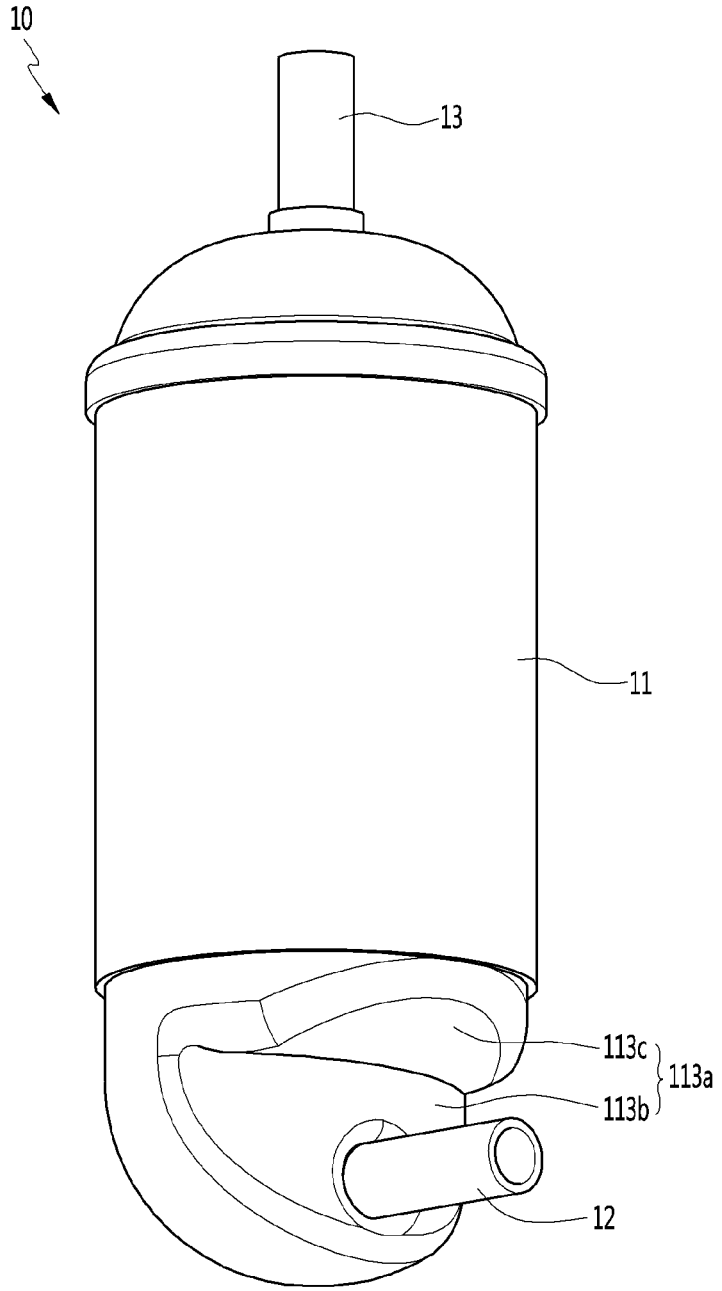
FIG. 2 is a perspective view of the accumulator according to the first embodiment of the invention.
Figure 3:
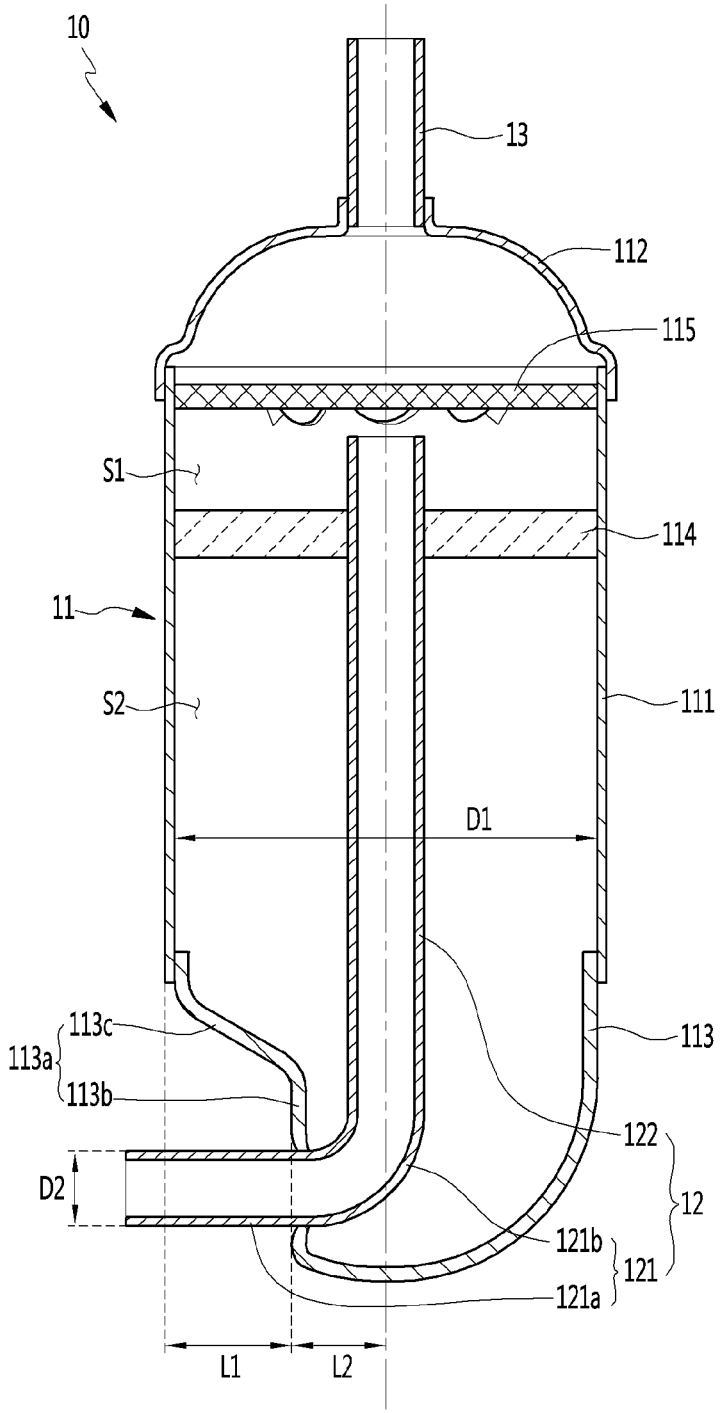
FIG. 3 is a longitudinal sectional view of the accumulator of FIG. 2.
Figure 4:
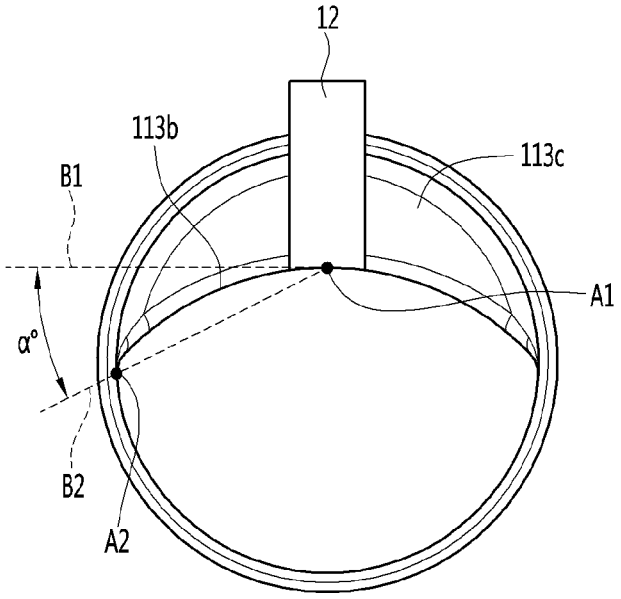
FIG. 4 is a view illustrating the accumulator of FIG. 2 as viewed from below.

FIG. 2 is a perspective view of an accumulator according to the first embodiment of the invention, FIG. 3 is a longitudinal sectional view of the accumulator of FIG. 2, and FIG. 4 is a view illustrating the accumulator of FIG. 2 as viewed from below.

With reference to FIG. 2 to FIG. 4, the accumulator 10 may include an accumulator main body 11, a connection pipe 12 which is inserted into the accumulator main body 11 by a predetermined length, and a suction pipe 13 which is coupled to an upper end portion of the accumulator main body 11.

The accumulator 10 separates gaseous refrigerant in the refrigerant and supplies the separated gaseous refrigerant to a compression space of the cylinder 6. The liquid refrigerant separated through the accumulator 10 is stored in an inner space of the accumulator 10.

The accumulator main body 11 may include a case, a vibration preventing plate 114, and a screen member 115.

The case provides a space in which the refrigerant flows in and is separated therein. The case may be generally formed in a substantially cylindrical shape, but is not limited thereto. The inner space formed by the case may be separated into an upper space S1 and a lower space S2 by the vibration preventing plate 114 (described below).

The case may include a body 111 of which upper portion and lower portion are opened, an upper cap 112 which is coupled to the upper side of the body 111, and a lower cap 113 which is coupled to the lower side of the body 111.

The body 111 may be formed in a cylindrical shape (not limited thereto) and the upper portion and the lower portion thereof may be sealed by the upper cap 112 and the lower cap 113, respectively.

The vibration preventing plate 114 may be provided in the body 11.

The vibration preventing plate 114 secures the connection pipe 12 which is inserted in the case. The vibrating preventing plate 114 may be coupled to an outer circumferential surface of the connection pipe 12 and for this, a through hole (not illustrated) may be formed on the center of the vibration preventing plate 114.

For example, the vibration preventing plate 114 may be formed having a disk shape and in contact with the inner circumferential surface of the body 111 and the outer circumferential surface of the connection pipe 12 so that the connection pipe 12 can be firmly supported and not vibrate by the vibration of the compressor.

The vibration preventing plate 114 may be positioned in the case to separate the inner space of the case into an upper space S1 and a lower space S2.

At least one vertical through hole (not illustrated) may be formed in the vibration preventing plate 114. The liquid refrigerant collected on the upper surface of the vibration preventing plate 114 drops through the through hole to the lower side of the vibration preventing plate 114.

The upper cap 112 may be coupled to seal the opened upper surface of the body 111. A suction pipe 13 may be coupled to the upper side of the upper cap 112.

The suction pipe 13 can be understood as a pipe through which a low-temperature and low-pressure refrigerant flows from a heat exchanger (e.g., evaporator) which is not illustrated. At this time, the refrigerant flowing through the suction pipe 13 may be a mixed refrigerant in which the gaseous refrigerant and the liquid refrigerant are mixed.

Preferably, the refrigerant supplied to the compressor is a low-temperature and low-pressure gaseous refrigerant. However, in reality, the low-temperature and low-pressure liquid refrigerant is partially mixed therein due to various factors. If such a liquid refrigerant flows into the compressor, since it may cause damage to the compressor, it is necessary to separate the liquid refrigerant from the accumulator.

A screen member 115 may be disposed in the body 111 to filter the liquid refrigerant. The screen member 115 is a structure that passes the gaseous refrigerant in the refrigerant suctioned through the suction pipe 13 and that filters the liquid refrigerant. The screen member 115 may be disposed above the vibration preventing plate 114.

For example, the screen member 115 may be spaced apart and upward from the end portion of the connection pipe 12. Therefore, the gaseous refrigerant in the refrigerant suctioned into the case through the suction pipe 13 flows into the connection pipe 12 through the screen member 115, the liquid refrigerant is filtered by the screen member 115, and may be dropped downward through holes (not illustrated) provided in the screen member 115.

The liquid refrigerant that is dropped below the screen member 115 may be collected on the upper surface of the vibration preventing plate 114. The liquid refrigerant collected on the vibration preventing plate 114 may pass through the through hole and then may drop into a bottom of the lower cap 113.

The liquid refrigerant that is dropped to the bottom of the lower cap 113 may rise while it is vaporized by the surrounding heat and may be suctioned into the suction portion of the cylinder 6 through the connection pipe 12. The vibration generated while the gaseous refrigerant passes through the connection pipe 12 can then be significantly reduced by the vibration preventing plate 114.

On the other hand, the lower cap 113 may be coupled to seal the opened lower portion of the body 111. A portion of the lower cap 113 may be recessed inward and the connection pipe 12 may be inserted into the recessed surface thereof.

Specifically, as illustrated in FIG. 2 and FIG. 3, the lower cap 113 may include a recessed portion 113*a* which is partially recessed from the outside to the inside.

The depressed portion 113*a* may include a stepped surface 113*b*. The stepped surface 113*b* may be spaced apart from an outer circumferential surface of the lower cap 113 by a predetermined distance in the center direction of the lower cap 113.

The stepped surface 113*b* may be recessed by a predetermined distance L1 from the outer circumferential surface of the body 111 in an inside direction. The connection pipe 12 may be inserted into the stepped surface 113*b* and the center of the connection pipe 12 may be positioned below a line vertically bisecting the stepped surface 113*b*.

The reason for this is that when the connection pipe 12 is positioned near the bottom surface of the lower cap 113, the liquid refrigerant stored in the bottom surface of the lower cap 113 is more easily vaporized by heat of the liquid refrigerant flowing in the connection pipe 12.

In addition, the reason is that as the connection pipe 12 is closer to the bottom surface of the lower cap 113 since a larger clearance is formed on the upper side of the connection pipe 12, it is easy to install the connection pipe 12 in the guide portion 1*e* of the compressor 1.

Therefore, in the present embodiment, for example, the connection pipe 12 may be disposed at the center point of the stepped surface 113*b* but may be disposed at a lower position of the stepped surface 113*b* due to the above reason.

The connection pipe 12 may be inserted at any position on the stepped surface 113*b*. To this end, a through hole (not illustrated) is formed on the stepped surface 113*b* that allows the connection pipe 12 to pass therethrough. The through hole has a size and a shape corresponding to the diameter of the connection pipe 12. In the present embodiment, for example, in order to form the through hole, the stepped surface 113*b* may be perforated from the inside to the outside. During the perforating process, a bur may be formed on the outer surface of the stepped surface 113*b* and this bur may protrude outward from the through hole. Therefore, insertion of the connection pipe from the inside to the outside of the through hole is not disturbed by the bur and there is also an advantageous effect in pipe welding.

The connection pipe 12 may include a first pipe portion 121 and a second pipe portion 122.

The first pipe portion 121 may include a horizontal portion 121*a* which extends horizontally and passes through the stepped surface 113*b*, and a bent portion 121*b* which is bent upward at an end portion of the horizontal portion 121*a*. The second pipe portion 122 may extend further and upwardly from the end portion of the bent portion 121*b*.

In other words, the connection pipe 12 may have a shape which extends through the stepped surface 113*b* into the body 111 and then is bent in an upward direction. In other words, the connection pipe 12 may be formed to be bent in a substantially "¬" shape. At this time, the center of the second pipe portion 122 and the center of the body 111 may coincide with each other. The vibration preventing plate 114 may be coupled to the periphery of the second pipe portion 122.

On the other hand, the distance between the stepped surface 113*b* and the outer peripheral surface of the body 111 is preferably maintained at a predetermined distance L1.

If the gap between the stepped surface 113*b* and the outer circumferential surface of the body 111 is too wide, the stepped surface 113*b* and the connection pipe 12 positioned in the body 111 may collide with each other, which is problem some. Also, the vibration can be largely transferred to the body 111 side through the connection pipe 12.

On the contrary, if the gap between the stepped surface 113*b* and the outer peripheral surface of the body 111 is too narrow since the working space for installing the connection pipe 12 in the compressor 1 becomes narrow, then it becomes more difficult to physically install the connection pipe 12.

In order to solve such a problem, in this embodiment, for example, a distance L1 between the stepped surface 113*b* and the outer circumferential surface of the body 111 may be less than a value obtained by subtracting the diameter D2 of the connection pipe 12 from a radius D1/2 of the body 111.

As another example, for example, the radius D1/2 of the body 111 is a sum of a distance L1 from the outer circumferential surface of the body 111 to the stepped surface 113*b* and a distance L2 from a center of the body 111 to the stepped surface 113*b* and L1 may be formed to be greater than L2.

As another example, for example, the distance L2 from the center of the body 111 to the stepped surface 113*b* may be greater than the radius D2/2 of the connection pipe 12. Alternatively, the distance L2 from the center of the body 111 to the stepped surface 113*b* may be preferably formed to be greater than the diameter D2 of the connection pipe 12, considering the safety factor.

In addition, the stepped surface 113*b* may be rounded in the circumferential direction of the body 111.

The stepped surface 113*b* is rounded in the circumferential direction of the body 111 so that the working space in which the connection pipe 12 can be joined to the guide portion 1*e* of the compressor 1 can be widened.

Specifically, as illustrated in FIG. 4, the stepped surface 113*b* is rounded having a predetermined curvature in the circumferential direction of the body 111.

For example, based on FIG. 4, a predetermined angle (α°) may be formed between an extension line B1 which extends perpendicularly to the connection pipe 12 while passing through the intermediate point A1 of the stepped surface 113*b* and a connection line B2 which connects an intermediate point A1 of the stepped surface 113*b* and the end point A2 of the stepped surface 113*b* to each other.

If the angle between the extension line B1 and the connection line B2 is too small, then the working space for installing the connection pipe 12 to the compressor 1 narrows, making it more difficult for an operator to install the connection pipe 12.

On the contrary, if the angle between the extension line B1 and the connection line B2 is too large, it is difficult to satisfy the volume of the accumulator required in the compressor, and the stability thereof is deteriorated.

In order to solve such a problem, in this embodiment, for example, the angle between the extension line B1 and the connection line B2 may be greater than 10 degrees and less than 35 degrees.

With such a configuration, the accumulator can be installed as close as possible to the compressor, and at the same time, a working space which is required for installing the connection pipe of the accumulator in the suction portion of the compressor can be provided. In addition, since the compressor and the accumulator are disposed so close to each other, vibration of the accumulator due to vibration transferred from the compressor to the accumulator can be minimized and thus noise can be greatly reduced.

The recessed portion 113*a* may further include an inclined surface 113*c*. The inclined surface 113*c* may be inclined upwardly from the upper end of the stepped surface 113*b* and may extend in a direction away from the center of the lower cap 113. The inclined surface 113*c* may be connected to the stepped surface 113*b*.

In other words, in the present invention, for example, by having the stepped surface 113*b* and an inclined surface 113*c* formed to be inclined from the upper end of the stepped surface 113*b*, the working space for connecting the connection pipe 12 to the compressor 1 can be provided.

On the other hand, an inner height of the recessed portion 113*a*, that is, the height H3 between the lower end and the upper end of the stepped surface 113*b*, has to be secured to be a minimum height for fixing a support which is required for perforating the through hole into which the connection pipe 12 is inserted. Otherwise, there may be a problem that the shape of the hole is biased when forming the through hole into which the connection pipe 12 is inserted. Accordingly, although not limited thereto, in the present invention, the height H3 of the stepped surface 113*b* may be at least twice as large as the diameter D2 of the connection pipe 12.

The operation according to the accumulator configuration will be briefly described.

A low-temperature and low-pressure refrigerant is suctioned through the suction pipe 13 from the heat exchanger (e.g., evaporator) not illustrated. The refrigerant suctioned through the suction pipe 13 passes through the screen member 115 and foreign matter and liquid refrigerant are filtered therefrom.

The gaseous refrigerant in the refrigerant passes through the screen member 115 and then is suctioned to the suction side of the compressor 1 through the connection pipe 13.

The liquid refrigerant filtered by the screen member 115 is dropped through the holes formed in the screen member 115 and is collected on the vibration preventing plate 114. The liquid refrigerant collected on the vibration preventing plate 114 passes through the through hole formed in the vibration preventing plate 114 and is dropped to the bottom of the lower cap 113.

The liquid refrigerant that is dropped to the bottom of the lower cap 113 is lifted while being vaporized by the surrounding heat and suctioned again into a suction chamber of the cylinder 6 through the connection pipe 12.

Figure 5:
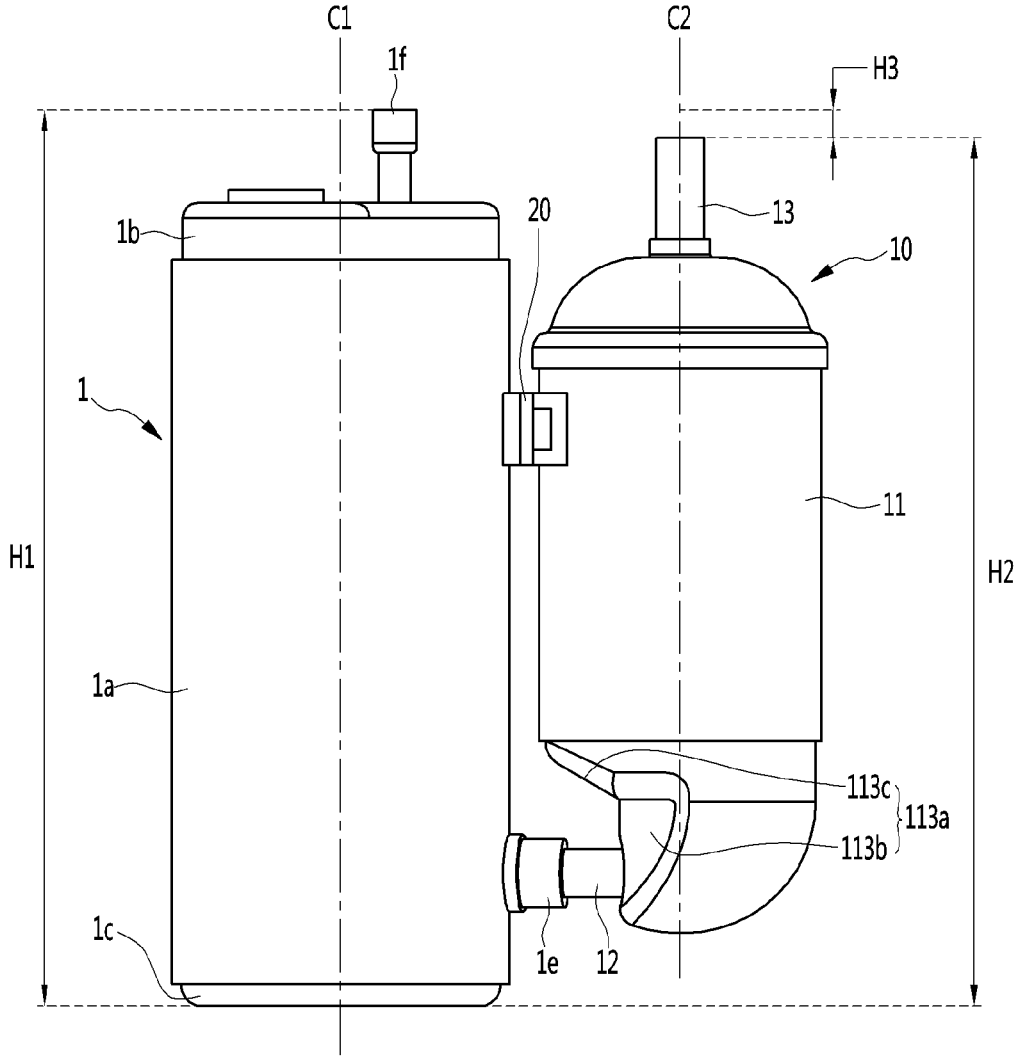
FIG. 5 is a view illustrating a state where the accumulator according to the first embodiment of the invention is coupled to a compressor.

FIG. 5 is a view illustrating a state where the accumulator according to the first embodiment of the present invention is coupled to the compressor.

With reference to FIG. 5, the accumulator 10 is connected to the outside of the compressor 1.

Specifically, the upper portion of the accumulator 10 can be supported by a supporting device 20 fixed to the outside of the compressor 1.

The support device 20 is installed so as to surround a portion of the periphery of the accumulator 10 so that the accumulator 10 can be fixed to the compressor 1.

In addition, the accumulator 10 can be supported by the compressor 1 by the connection pipe 12 being inserted into the guide portion 1*e* of the compressor 1 in the lower portion of the accumulator 10.

The connection pipe 12 may be inserted into the guide portion 1*e*.

As an example, an expansion portion is formed on the outer circumferential surface of the connection pipe 12, and the expansion portion can be welded to the inner circumferential surface of the guide portion 1*e*. In other words, in order to install the connection pipe 12 on the compressor 1 side, since the expansion portion has to be welded to the inner circumferential surface of the guide portion 1*e*, a predetermined working space is required.

In the present invention, since a portion of the accumulator to which the connection pipe 12 is coupled has a shape which is recessed inward, there is an advantage that an operator can easily weld the connection pipe 12 to the guide portion 1*e* of the compressor 1.

In the present invention, the welding is characterized by performing brazing welding using a welding agent of copper or a copper alloy.

In addition, the connection pipe 12 of the present invention has not a structure which extends from the bottom surface of the accumulator 10 and is connected to the compressor 1 side but has a structure which extends from the side surface of the accumulator 10 and is connected to the suction portion of the compressor 1 and thus the vertical center C1 of the compressor 1 and the vertical center C2 of the accumulator 1 become close to each other. Accordingly, since the accumulator 10 can be installed to be closer to the compressor 1, the vibration generated in the compressor 1 can be minimally transferred to the accumulator 10.

In addition, since the connection pipe according to the structure of the conventional art has a structure which extends from the bottom surface of the accumulator and is connected to the compressor side, there is a problem that the design height of the accumulator is increased. Accordingly, there is a problem that the overall height of the accumulator becomes higher than the overall height of the compressor, thereby increasing the overall height of the product.

However, since the accumulator 10 according to the present invention can have a significantly lowered design height than the accumulator of the conventional art, the height H2 of the accumulator 10 can be less than or equal to the height H1 of the compressor 10. Accordingly, the design height of the accumulator 10 is significantly lowered, and thus there is an advantage that the overall height of the product can be lowered.

The height H2 of the accumulator 10 may be a distance from the ground to the upper end portion of the suction pipe 13 of the accumulator 10 and the height H1 of the compressor 1 may be a distance from the ground to the upper end portion of the discharge pipe if of the compressor 1.

Figure 6:
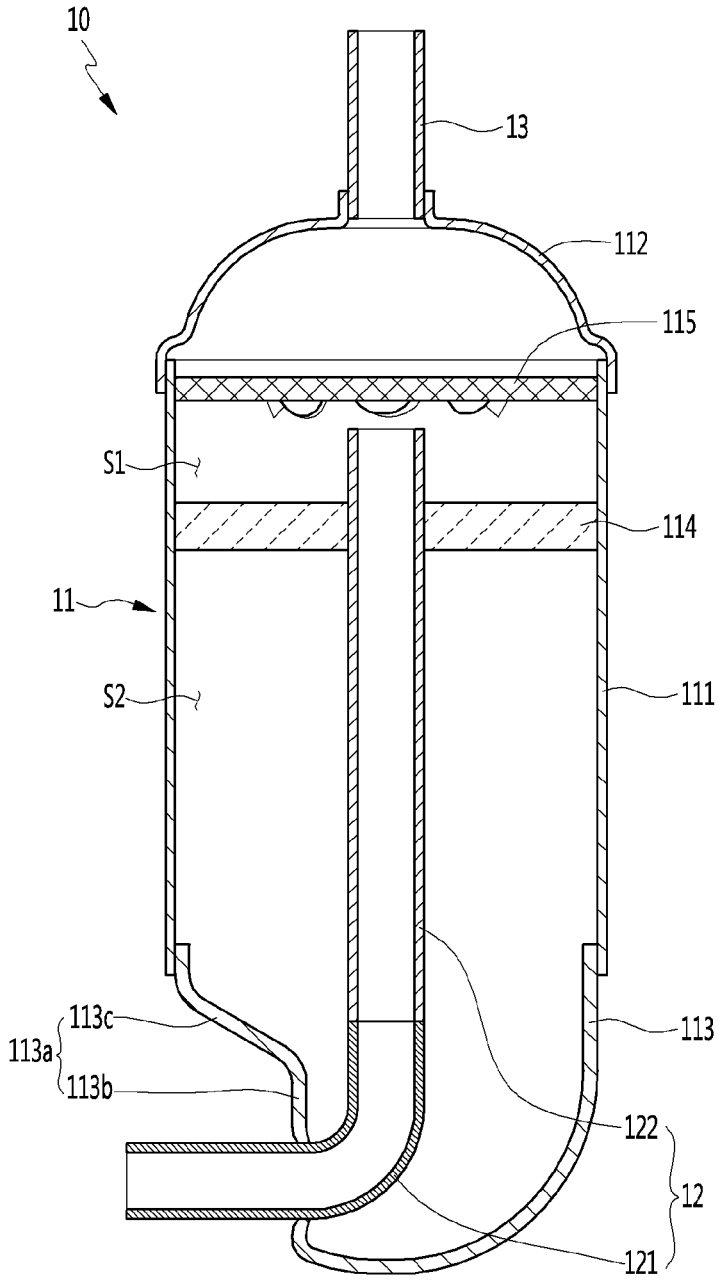
FIG. 6 is a longitudinal sectional view of an accumulator according to a second embodiment of the invention.

FIG. 6 is a longitudinal sectional view of an accumulator according to a second embodiment of the present invention.

The second embodiment is generally the same as the first embodiment except for the structure of the connection pipe. Accordingly, only characteristic portions of the second embodiment will be described below and the same portions as those of the first embodiment will be referred to those.

With reference to FIG. 6, the accumulator 10 according to the second embodiment includes an accumulator body 11 that forms an inner space, a connection pipe 12 that is inserted into the accumulator body 11 by a predetermined length, and a suction pipe 13 that is coupled to the upper end portion of the accumulator body 11.

Since the accumulator main body 11 and the suction pipe 13 have the same structure as those of the first embodiment, a detailed description thereof will be omitted.

The connection pipe 12 according to the second embodiment may include a first pipe portion 121 formed of copper (Cu) material and a second pipe portion 122 formed of a steel material.

For example, the first pipe portion 121 is formed of a curved pipe formed of a copper material, and the second pipe portion 122 is formed of a straight pipe formed of a steel material.

The first pipe portion 121 may extend horizontally and pass through the stepped surface 113*b* and then be bent and extended upward. The second pipe portion 122 may be mechanically coupled or welded to the end portion of the first pipe portion 121.

In the conventional art, the connection pipe is formed entirely of either a copper or a steel material. When the connection pipe is made entirely of copper material, there is a disadvantage that the manufacturing cost of the pipe increases because the copper is relatively expensive. When the connection pipe is made of a steel material, the manufacturing cost of the pipe decreases; however, because of its low ductility, it is difficult to form the curved pipe.

Therefore, in the present embodiment, the curved pipe portion of the connection pipe 12 is a pipe formed of copper material, and the straight pipe portion of the connection pipe 12 is a pipe formed of a steel material, thereby there are advantages that the manufacturing cost of the pipe is reduced and the workability of the connection pipe can be secured.

Figure 7:
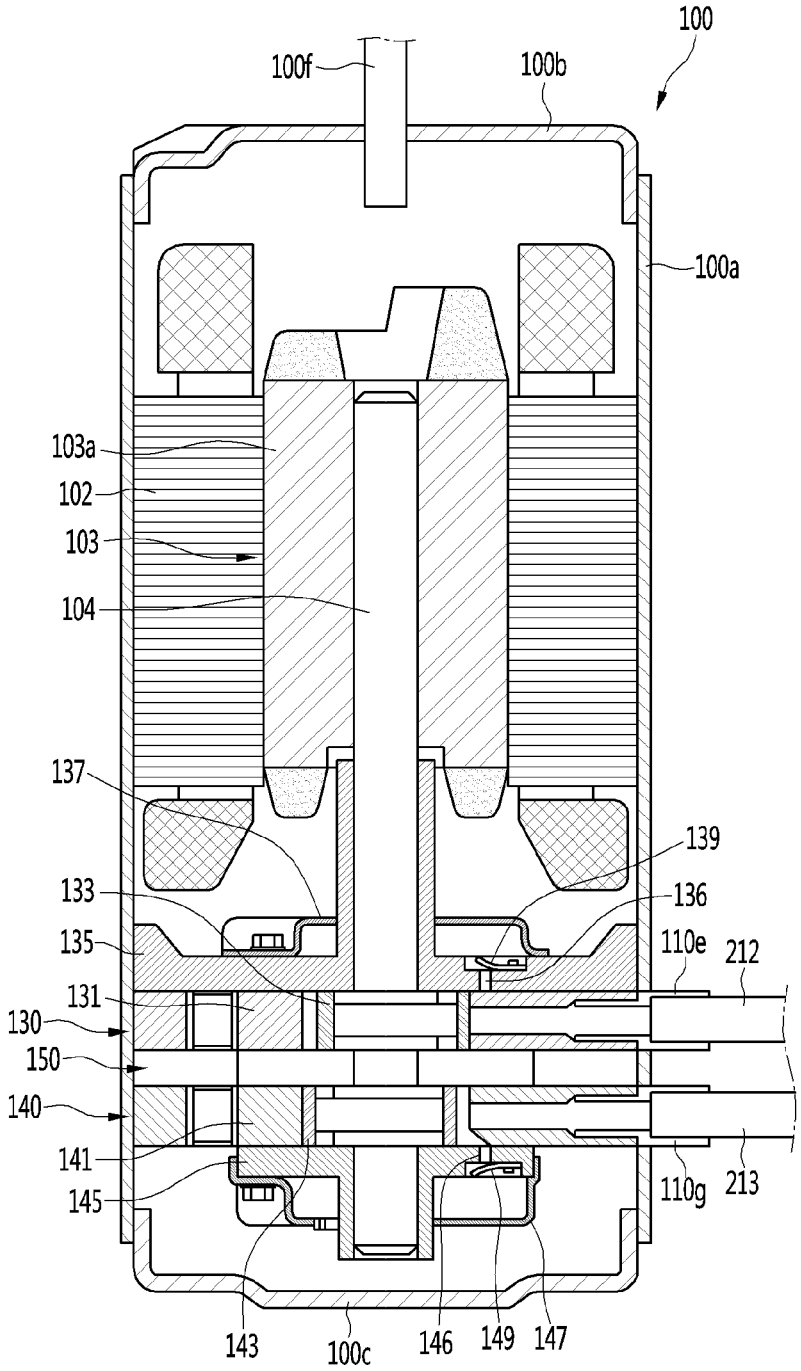
FIG. 7 is a longitudinal sectional view illustrating a configuration of a compressor according to a third embodiment of the invention.

FIG. 7 is a longitudinal sectional view illustrating a configuration of a compressor according to a third embodiment of the present invention.

Referring to FIG. 7, the compressor 100 may be a twin rotary compressor having two cylinders in which a compression space for compressing refrigerant is formed.

The compressor 100 may include a case 100*a* that forms an inner space, a top cover 100*b* that is coupled to the upper side of the case 100*a*, and a bottom cover 100*c* that is coupled to the lower side of the case 100*a*.

The case 100*a* may be formed in a cylindrical shape (not limited thereto) of which an upper portion and a lower portion are open. The case 100*a* may include guide portions 110*e* and 110*g* to which connection pipes 212 and 213 of the accumulator may be connected.

A plurality of guide portions 110*e* and 110*g* may be provided. For example, the guide portions 110*e* and 110*g* may include a first guide portion 110*e* and a second guide portion 110*g*.

The first guide portion 110*e* and the second guide portion 110*g* are spaced apart from each other. In an non-limiting example, the first guide portion 110*e* and the second guide portion 110*g* may be spaced apart in the vertical direction (relative to the ground). The first guide portion 110*e* and the second guide portion 110*g* may have a pipe shape and may have the same outer diameter or the same inner diameter.

The first guide portion 110*e* and the second guide portion 110*g* allow the first connection portion 212 and the second connection portion 213 extending from the accumulator to be inserted into the first guide portion 110*e* and the second guide portion 110*g* and allow the refrigerant to be supplied to the suction portion of the compressor 100 from the accumulator.

The top cover 100*b* may be coupled so as to cover the opened upper surface of the case 100*a*. The top cover 100*b* may be provided with a discharge pipe 100*f* through which the refrigerant compressed in the cylinders 131 and 141 of the compressor 100 is discharged. For example, the discharge pipe 100*f* may pass through a portion of the top cover 100*b*.

A motor may be provided inside the case 100*a*. The motor may include a stator 102 that generates a magnetic force by an applied power and a compression mechanism portion 103 that compresses the refrigerant by induced electromotive force generated through interaction with the stator 102.

The compression mechanism portion 103 may include a rotor 103*a* which is provided inside the stator 102 and rotates. The stator 102 and the rotor 103*a* are components of the motor. The compression mechanism portion 103 may further include a rotation shaft 104 coupled to the rotor 103*a* and rotated according to rotation of the rotor 103*a*.

The compression mechanism portion 103 may include an upper compression unit 130 and a lower compression unit 140. The upper compression unit 130 and the lower compression unit 140 may be disposed to be vertically spaced apart from each other (relative to the ground).

The upper compression unit 130 may include an upper cylinder 131 forming an upper chamber in which the refrigerant is compressed and an upper roller 133 positioned in the upper chamber and connected to the rotation shaft 104.

The upper roller 133 is eccentrically coupled to the rotation shaft 104 and may be rotated with a predetermined eccentric trajectory according to the rotation of the rotation shaft 104.

An upper vane slot may be formed in the upper cylinder 131 and an upper vane may be accommodated therein. The upper vane reciprocates in the upper vane slot to separate the upper chamber into a suction chamber and a compression chamber.

The upper cylinder 131 may be provided with an upper refrigerant suction portion for introducing the refrigerant.

The upper refrigerant suction portion may be connected to a first connection pipe 212 of the accumulator to receive the refrigerant.

The upper compression unit 130 may include a main bearing 135 placed on the upper cylinder 131. The main bearing 135 may be fixed to the inner peripheral surface of the case 100*a* and cover the upper side of the upper chamber. The main bearing 135 may be positioned below the motor to be spaced apart from the motor. The main bearing 135 may be formed with an upper discharge portion 136 through which the refrigerant compressed in the upper chamber is discharged.

The upper discharge portion 136 is a passage through which the refrigerant compressed in the compression chamber is discharged when the pressure in the compression chamber of the upper cylinder 131 is greater than or equal to the discharge pressure. An upper discharge valve 139 that controls the discharge of the compressed refrigerant may be provided at one side of the upper discharge portion 136.

The upper discharge valve 139 may be disposed in the main bearing 135 positioned above the upper cylinder 131. Accordingly, the refrigerant discharged through the upper discharge portion 136 may be introduced into an upper muffler 137 positioned above the main bearing 135.

The rotation shaft 104 passes through the main bearing 135 and is connected to the rotor 103*a*. The main bearing 135 guides the rotation so that the rotation shaft 104 is stably rotated without being eccentric.

In addition, an upper muffler 137 may be provided on the upper side of the main bearing 135. The upper muffler 137 can reduce the noise generated during the discharge of the refrigerant compressed in the upper chamber.

The rotating shaft 104 may pass through the upper muffler 137. The upper muffler 137 may be formed with a through hole through which the rotation shaft 104 passes.

On the other hand, the lower compression unit 140 may include a lower cylinder 141 forming a lower chamber in which a refrigerant is compressed and a lower roller 143 positioned in the lower chamber and connected to the rotation shaft 104.

The lower roller 143 may be eccentrically coupled to the rotation shaft 104 and may be rotated with a predetermined eccentric trajectory according to the rotation of the rotation shaft 104.

A lower vane slot may be formed in the lower cylinder 141, and a lower vane can be accommodated therein. The lower vane reciprocates in the lower vane slot to separate the lower chamber into a suction chamber and a compression chamber.

The lower cylinder 141 may be provided with a lower refrigerant suction portion for introducing the refrigerant. The lower refrigerant suction portion may be connected to the second connection pipe 213 of the accumulator to receive the refrigerant.

The lower compression unit 140 may further include a sub-bearing 145 provided below the lower cylinder 141. The sub-bearing 145 may be fixed to the inner peripheral surface of the case 100*a* and cover the lower side of the lower chamber. The sub-bearing 145 may be formed with a lower discharge portion 146 through which the refrigerant compressed in the lower chamber is discharged.

The lower discharge portion 146 is a passage through which the refrigerant compressed in the compression chamber is discharged when the compression chamber pressure of the lower cylinder 141 is greater than or equal to the discharge pressure. A lower discharge valve 149 that controls the discharge of the compressed refrigerant may be provided at one side of the lower discharge portion 146.

The lower discharge valve 149 may be disposed in a sub-bearing 145 positioned below the lower cylinder 141. Accordingly, the refrigerant discharged through the lower discharge portion 146 can be introduced into the lower muffler 147 positioned below the sub-bearing 145.

The rotation shaft 104 may pass through the sub-bearing 145. Therefore, the sub-bearing 145 guides the rotation so that the rotation shaft 104 is stably rotated without being eccentric.

In addition, a lower muffler 147 may be provided on the lower side of the sub-bearing 145. The lower muffler 147 can reduce the noise generated during the discharge of the refrigerant compressed in the lower chamber.

The compression mechanism portion 103 may further include an intermediate plate 150 positioned between the upper cylinder 131 and the lower cylinder 141.

The intermediate plate 150 may cover the lower side of the upper chamber and the upper side of the lower chamber. In other words, the intermediate plate 150 prevents the upper roller 133 and the lower roller 143 from directly contacting or rubbing against each other during the rotation of the rotation shaft 104. The rotation shaft 104 passes through the intermediate plate 150.

On the other hand, the refrigerant compressed in the lower chamber is discharged to the inner space of the lower muffler 147. The refrigerant discharged to the inner space of the lower muffler 147 flows through the sub-bearing 145, the lower cylinder 141, the intermediate plate 150, the upper cylinder 131, and the main bearing 135 sequentially and flows into the inner space of the upper muffler 137.

A refrigerant passage opening (not illustrated) for passing refrigerant may be formed on each of the sub-bearing 145, the lower cylinder 141, the intermediate plate 150, the upper cylinder 131, and the main bearing 135.

The operation according to the configuration of the twin rotary compressor described above will be described below.

When the rotation shaft 104 is rotated, the upper roller 133 and the lower roller 143 rotate and revolve along the inner peripheral surfaces of the upper cylinder 131 and the lower cylinder 141 while forming a predetermined eccentric trajectory. The refrigerant stored in the accumulator flows into the compression chambers of the upper cylinder 131 and the lower cylinder 141 through the first connection pipe 212 and the second connection pipe 213, respectively. During the rotation of the upper roller 133 and the lower roller 143, the refrigerant is compressed in each of the compression chambers.

At this time, the amounts of refrigerant compressed in the upper cylinder 131 and the lower cylinder 141 may be equal or substantially equal to each other. Alternatively, the amount of refrigerant compressed in the upper cylinder 131 may be less than or greater than the amount of refrigerant compressed in the lower cylinder 141.

Then, when the pressure in each compression chamber is greater than or equal to the discharge pressure, the upper discharge valve 139 and the lower discharge valve 149 provided at one side of the upper discharge portion 136 and the lower discharge portion 146 are opened, respectively, and the compressed refrigerant is discharged from the upper discharge portion 136 and the lower discharge portion 146 through the opened upper discharge valve 139 and the opened lower discharge valve 149.

The compressed refrigerant discharged from the upper discharge portion 136 passes through the upper muffler 137 and is discharged to the outside through the discharge pipe

100*f*. The compressed refrigerant discharged from the lower discharge portion 146 flows through the inner space of the lower muffler 147 and then rises to the refrigerant passage opening formed at one side of the sub-bearing 145. Subsequently, the compressed refrigerant passes through the refrigerant passage openings formed in the lower cylinder 141, the intermediate plate 150, the upper cylinder 131 and the main bearing 135, respectively and rises, so that the refrigerant flows into the inner space of the upper muffler 137.

Figure 8:
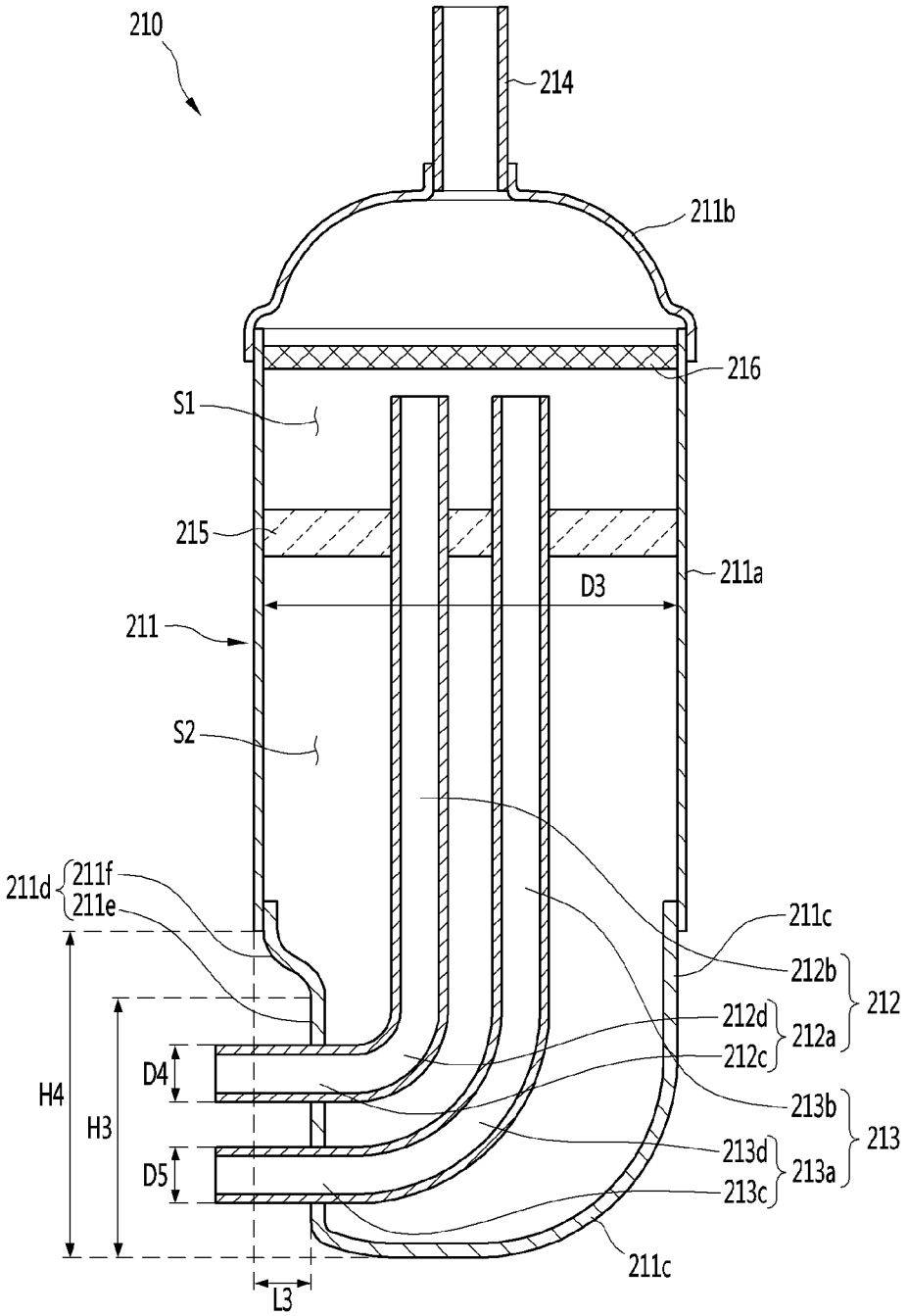
FIG. 8 is a longitudinal sectional view of the accumulator according to the third embodiment of the invention.

The refrigerant flowing into the inner space of the upper muffler 137 repeats a series of processes that the refrigerant is discharged to the refrigeration cycle apparatus (not illustrated) through the discharge pipe 100*f* together with the compressed refrigerant discharged from the upper discharge section 136 and then is suctioned back into the compression chambers of the cylinders 131 and 141 through the accumulator. FIG. 8 is a longitudinal sectional view of the accumulator according to the third embodiment of the present invention.

The accumulator according to the third embodiment is the same as the accumulator according to the first embodiment except that the accumulator has two connection pipes. Therefore, a detailed description of the same configuration as the first embodiment will be omitted.

Referring to FIG. 8, the accumulator 210 may include an accumulator body 211, a first connection pipe 212, and a second connection pipe 213 which are inserted into the accumulator body 211 by a predetermined length, and a suction pipe 214 which is coupled to an upper end portion of the accumulator main body 211.

The accumulator body 211 may include a case, a vibration preventing plate 215, and a screen member 216. The case provides a space in which refrigerant flows in and is separated. The case may generally have a substantially cylindrical shape (not limited thereto). The inner space formed by the case may be separated into an upper space S1 and a lower space S2 by a vibration preventing plate 215 to be described below.

The case may include a body 211*a* of which an upper portion and a lower portion are opened, an upper cap 211*b* which is coupled to the upper side of the body 211*a*, and a lower cap 211*c* which is coupled to the lower side of the body 211*a*.

The body 211*a* may have a cylindrical shape (not limited thereto) and the upper portion and the lower portion thereof may be sealed by the upper cap 211*b* and the lower cap 211*c*, respectively.

A vibration preventing plate 215 may be provided inside the body 211*a*. The vibration preventing plate 215 may hold or support the first connection pipe 212 and the second connection pipe 213 inserted into the case. The vibration preventing plate 215 may be coupled to the outer peripheral surface of the first connection pipe 212 and the outer peripheral surface of the second connection pipe 212*b*, and in this end, two through hole (not illustrated) may be formed on the vibration preventing plate 215.

For example, the vibration preventing plate 215 may have a disc shape (not limited thereto) and be in close contact with the inner peripheral surface of the body 211*a* and the inner peripheral surfaces of the first connection pipe 212 and the second connection pipe 213 so that the first connection pipe 212 and the second connection pipe 213 are not shaken by vibration, or any such shaking is significantly reduced.

In addition, the vibration preventing plate 215 may be positioned inside the case to separate the inner space of the case into an upper space S1 and a lower space S2.

In addition, at least one vertical passage hole (not illustrated) may be formed on the vibration preventing plate 215. Accordingly, the liquid refrigerant, which is collected on the upper surface of the vibration-preventing plate 215, is allowed to fall under the vibration-preventing plate 215 through the passage hole.

The upper cap 211*b* may be coupled to seal the opened upper surface of the body 211*a*. The suction pipe 214 may be coupled to the upper portion of the upper cap 211*b*.

The suction pipe 214 is understood to be a pipe through which a low-temperature low-pressure refrigerant flows from a heat exchanger (e.g., evaporator) which is not illustrated. The refrigerant flowing through the suction pipe 214 may be a mixed refrigerant in which the gaseous refrigerant and the liquid refrigerant are mixed.

A screen member 216 is disposed inside the body 211*a*. The screen member 216 can be understood as a member that passes the gaseous refrigerant and filters the liquid refrigerant in the refrigerant suctioned through the suction pipe 214. The screen member 216 may be provided above the vibration preventing plate 215.

The lower cap 211*c* may be coupled to seal the opened lower portion of the body 211*a*. A portion of the lower cap 211*c* may be recessed inward, and the first connection pipe 212 and the second connection pipe 213 may be inserted into the recessed surface, respectively.

Specifically, as illustrated in FIG. 8, the lower cap 211*c* may include a recessed portion 211*d* of which a portion thereof is recessed from the outside to the inside. For example, the recessed portion 211*d* may be formed in an upward direction from a lower end portion of the lower cap 211*c*.

The recessed portion 211*d* may also include a stepped surface 211*e*. The stepped surface 211*e* may be spaced apart by a predetermined distance from the outer peripheral surface of the lower cap 211*c* toward the center of the lower cap 211*c*. At least a portion of the stepped surface 211*e* may be rounded in the peripheral direction of the body 211*a*. For example, the entirety of the stepped surface 211*e* may be rounded, or a portion of the stepped surface 211*e* adjacent to the through hole for passing through by the connection pipe 212 and 213 may be flat and the outer portion (or the remaining portion) thereof may be rounded.

The stepped surface 211*e* is rounded in the peripheral direction of the body 211*a* so that a working space that the first connection pipe 212 and the second connection pipe 213 can be joined to the guide portions 110*e* and 110*g* of the compressor 100 and widened.

Specifically, the stepped surface 211*e* may be recessed by a predetermined distance L3 in an inward direction from the outer surface of the body 211*a*. A plurality of connection pipes, e.g., the first connection pipe 212 and the second connection pipe 213, may be inserted into the stepped surface 211*e*. The first connection pipe 212 may be positioned above the line bisecting the stepped surface 211*e* vertically, and the second connection pipe 213 may be positioned below the line bisecting the stepped surface 211*e* vertically.

In other words, the first connection pipe 212 and the second connection pipe 213 may be spaced apart from each other in the vertical direction (relative to the ground). The stepped surface 211*e* may be provided with a first through hole (not illustrated) through which the first connection pipe 212 passes, and a second through hole (not illustrated) through which the second connection pipe 213 passes.

The first through holes and the second through holes have a size and a shape corresponding to the diameters of the first connection pipe 212 and the second connection pipe 213. In the present embodiment, for example, the first through hole and the second through hole may be perforated from the inside to the outside of the stepped surface 211*e*. In this case, in the perforating process, a bur may be formed on the outer surface of the stepped surface 211*e*, and this bur can protrude outward the through hole. Therefore, insertion of the connection pipe from the inside to the outside of the through hole will not be affected by the bur and there is also an advantageous effect in pipe welding.

The recessed portion 211*d* may include an inclined surface 211*f*. The inclined surface 211*f* may be inclined upward from the upper end of the stepped surface 211*e* and extend in a direction away from the center of the lower cap 211*c*. The inclined surface 211*f* may be connected to the stepped surface 211*e*.

In other words, in the present invention, for example, a working space that can join the connection pipes 212 and 213 to the compressor 100 can be provided by not only the stepped surface 211*e* but also the inclined surface 211*f* inclined from the upper end of the stepped surface 211*e*.

On the other hand, the inner height of the recessed portion 211*d*, that is, the height H3 between the lower end of the stepped surface 211*e* and the upper end of the stepped surface 211*e*, is secured by a minimum height for securing a support which is required for perforating the through hole into which the first connection pipe 212 and/or the second connection pipe 213 are inserted. If this is not done, the shape of the hole may be biased during the process of forming the through hole into which the first connection pipe 212 and/or the second connection pipe 213 are inserted.

Accordingly, although not limited thereto, in the present invention, for example, the height H3 of the stepped surface 211*e* may be designed to be at least three times as large as the diameter D4 of the first connection pipe 212 or the second connection pipe 213.

In addition, the outer height of the recessed portion 211*d*, that is, the height H4 between the lower end of the stepped surface 211*e* and the upper end of the inclined surface 211*f* is secured by a minimum height for welding the first connection pipe 212 to the compressor 110.

The first connection pipe 212 and the second connection pipe 213 may be inserted into through holes formed in the stepped surface 211*e*, respectively. Specifically, the first connection pipe 212 and the second connection pipe 213 may include first pipe portions 212*a* and 213*a* and second pipe portions 212*b* and 213*b*, respectively.

The first pipe portions 212*a* and 213*a* may include horizontal portions 211*c* and 213*c* which horizontally extend and pass through the stepped surface 211*e* and bent portions 212*c* and 213*c* which are bent upward at the ends of the horizontal portions 212*c* and 213*c*. The second pipe portions 212*b* and 213*b* may extend upward from the end portions of the bent portions 212*d* and 213*d*.

In other words, the shapes of the first connection pipe 212 and the second connection pipe 213 are similar to the shape of the connection pipe of the first embodiment described above. However, in the present invention, for example, there are two connection pipes for connecting the compressor and the accumulator to each other, and the connection pipes are vertically disposed.

Figure 9:
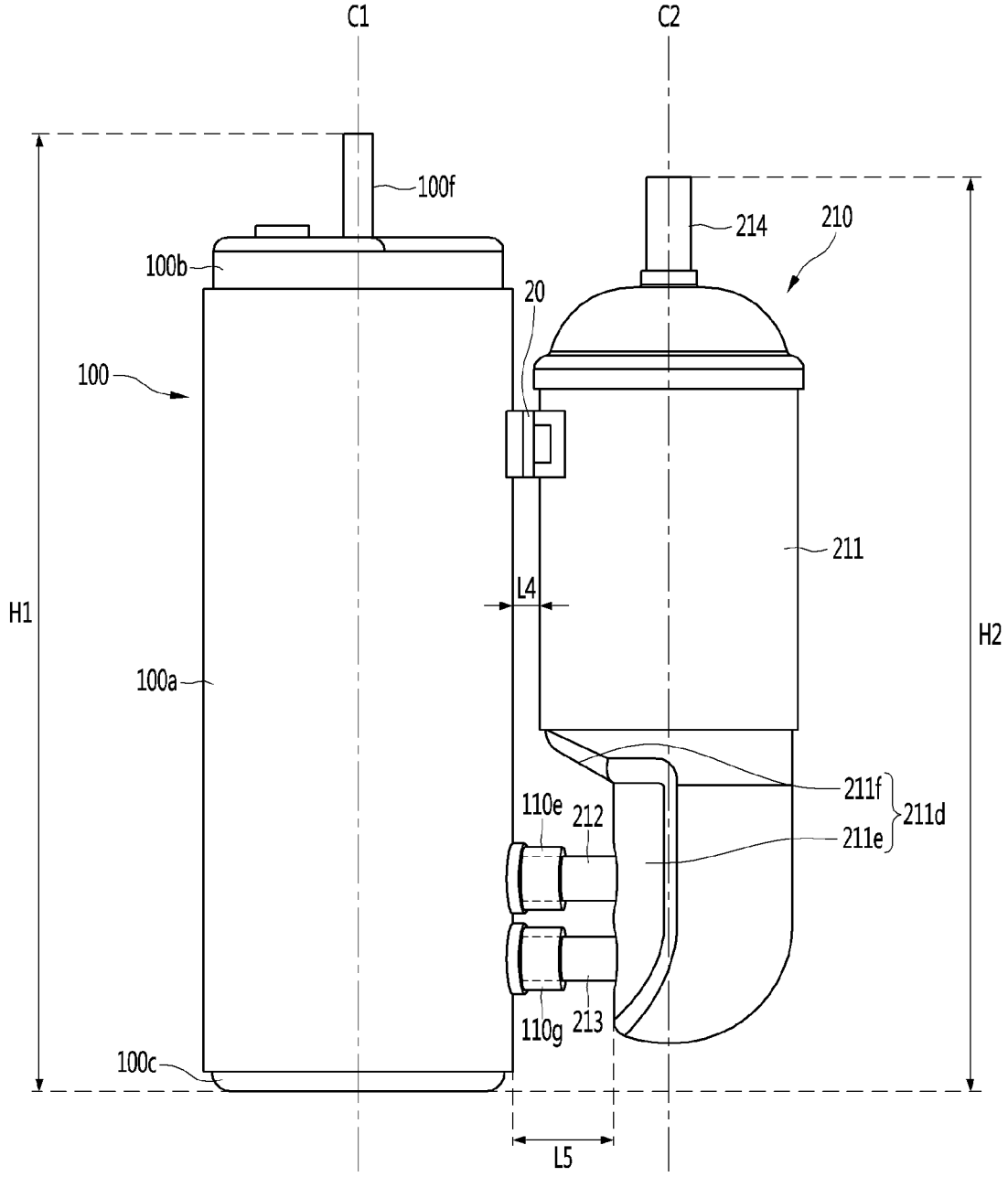
FIG. 9 is a view illustrating a state where an accumulator according to the third embodiment of the invention is coupled to a compressor.

FIG. 9 is a view illustrating a state where an accumulator according to a third embodiment of the present invention is coupled to a compressor.

Referring to FIG. 9, the accumulator 210 is connected to the outside of the compressor 100, that is, a side surface thereof. The upper portion of the accumulator 210 may be supported by a support device 20 fixed to the outside of the compressor 100.

The support device 20 may surround a portion of the periphery of the accumulator 210 to fix the accumulator 210 to the compressor 100.

The accumulator 210 may be configured such that the first connection pipe 212 and the second connection pipe 213 are inserted into the first guide portion 110*e* and the second guide portion 110*g* of the compressor 100 respectively, such that the accumulator 210 can be supported by the compressor 100.

According to the present invention, for example, the distance L4 between the side surface of the compressor 100 and the side surface of the accumulator 210 is shorter than the distance L5 of a portion of the connection pipe 212 and 213 from the side surface of the compressor 100 to the side surface of the accumulator 210. Accordingly, because the distance between the side surface of the compressor 100 and the side surface of the accumulator 210 is shorter than the length of the connecting pipe 212 and 213, the vibration transferred from the compressor 100 to the accumulator 210 is reduced or minimized and the noise is reduced or minimized.

The first connection pipe 212 and the second connection pipe 213 may be fixed to the inside of the first guide portion 110*e* and the second guide portion 110*g*, respectively. For example, the first connection pipe 212 and the second connection pipe 213 may be respectively formed with an expansion portion at the outer peripheral surface thereof. The respective expansion portions may be coupled to the inner peripheral surface of the first guide portion 110*e* and the second guide portion 110*g*, respectively, such as by welding (not limited thereto). In other words, when the expansion portions are welded to the inner peripheral surfaces of the guide parts 110*e* and 110*g*, a predetermined work space is required for the welding process.

In the present invention, for example, since a portion of the accumulator 210 to which the connection pipes 212 and 213 are coupled has a shape that is recessed inward, an operator can more easily weld the connection pipes 212 and 213 to the guide portions 110*e* and 110*g* of the compressor 100.

In the present invention, for example, the welding may be performed by a brazing welding process using a welding agent of copper or a copper alloy.

In addition, because the connection pipes 212 and 213 extend from the side surface of the accumulator 210 and are connected to the suction portion of the compressor 100, the vertical center C1 of the compressor 100 and the vertical center C2 of the accumulator 210 are positioned relatively close to each other.

In addition, since the connecting pipe according to the twin rotary compressor of the conventional art has a structure extending from the bottom surface of the accumulator and connected to the side surface of the compressor, there was a problem that the design height of the accumulator is increased.

However, because the accumulator 210 of the twin rotary compressor of the present invention can significantly reduce the design height compared with the structure of the conventional art, the height H2 of the accumulator 210 is equal to and lower than the height H1 of the compressor 100. Accordingly, since the design height of the accumulator 210 is decreased relative to the conventional art, there is an advantage that the overall height of products can be decreased.

In the present embodiment, only twin rotary compressors having two cylinders and two suction portions for introducing refrigerant into respective cylinders are described, but the present invention is not limited thereto.

For example, the present invention can be applied to a twin rotary compressor in which two cylinders are provided and a branch portion that supplies refrigerant into each cylinder is formed, and the branch portion branches the refrigerant into the upper cylinder and the lower cylinder, respectively. In other words, the cylinder of the compressor is configured by two cylinders, but one connecting pipe connecting the compressor and the accumulator may be provided. In this case, a twin rotary compressor may be provided as a compressor and the accumulator of the first embodiment in which one connecting pipe is provided may be applied as an accumulator.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An accumulator configured to be coupled to a compressor, the accumulator comprising:

a case having a cavity formed therein to accommodate refrigerant material;

a suction pipe connected to the case;

a first connection pipe configured to connect the case to a suction side of the compressor; and a second connection pipe configured to connect the case to the suction side of the compressor, the first connection pipe and the second connection pipe being spaced apart from each other and each extending outward from a side surface of the case, wherein the accumulator is configured so that in a state where the accumulator is coupled to the compressor, the side surface of the case is spaced apart from a facing side surface of the compressor by a distance that is less than a length of a portion of the first connection pipe or the second connection pipe that extends outward from the side surface of the compressor to the side surface of the case, wherein the case comprises a recessed portion that is partially recessed inward.

2. The accumulator of claim 1, wherein a first end of the first connection pipe is configured to be connected to the suction side of the compressor, and a second end of the first connection pipe is connected to the recessed portion of the case.

3. The accumulator of claim 1, wherein a first end of the second connection pipe is configured to connected to the suction side of the compressor, and a second end of the second connection pipe is connected to the recessed portion of the case.

4. The accumulator of claim 1, wherein the case comprises:

a body comprising an upper side and a lower side, wherein a cavity is formed inside body;

an upper cap covering at least a portion of the upper side and at which the suction pipe is disposed; and a lower cap covering at least a portion of the lower side of the body and at which the recessed portion is formed.

5. The accumulator of claim 4, wherein the recessed portion includes a stepped surface spaced apart by a predetermined distance from an outer peripheral surface of the lower cap toward the center of the lower cap, and wherein the stepped surface accommodates the first connection pipe and the second connection pipe.

6. The accumulator of claim 5, wherein the stepped surface comprises a through hole to accommodate the first connection pipe and the second connection pipe.

7. The accumulator of claim 6, wherein the stepped surface comprises a first through hole to accommodate the first connection pipe and a second through hole to accommodate the second connection pipe.

8. The accumulator of claim 7, wherein the first through hole is positioned above a line that vertically bisects the stepped surface and the second through hole is positioned below a line that vertically bisects the stepped surface.

9. The accumulator of claim 5, wherein the recessed portion further comprises an inclined surface that is inclined in an upward direction from an upper end of the stepped surface and extends in a direction away from a center of the lower cap.

10. The accumulator of claim 5, wherein the first connection pipe and the second connection pipe comprise:

a first pipe portion comprising a horizontal portion which extends horizontally and passes through the stepped surface and a bent portion which is bent in an upward direction at an end portion of the horizontal portion, and a second pipe portion that extends in an upward direction from an end portion of the bent portion.

11. The accumulator of claim 5, wherein at least a portion of the stepped surface is rounded in the peripheral direction of the body.

12. An accumulator comprising:

a case having a cavity formed therein to accommodate refrigerant material, the case comprising a recessed portion that is inwardly recessed;

a suction pipe connected to the case;

a first connection pipe comprising a first end that is configured to be connected to a suction portion of a compressor and a second end that is connected to the recessed portion; and a second connection pipe configured to be connected to the suction portion of the compressor and a second end that is connected to the recessed portion.

13. The accumulator of claim 12, wherein the case comprises:

a body comprising an upper side and a lower side, wherein a cavity is formed inside the body;

an upper cap covering at least a portion of the upper side of the body and at which the suction pipe is connected; and a lower cap covering at least a portion of the lower side of the body and at which the recessed portion is formed.

14. The accumulator of claim 13, wherein the recessed portion includes a stepped surface spaced apart by a predetermined distance from an outer peripheral surface of the lower cap toward the center of the lower cap, and wherein the stepped surface accommodates the first connection pipe and the second connection pipe.

15. The accumulator of claim 14, wherein the stepped surface comprises a through hole to accommodate the first connection pipe and the second connection pipe.

16. The accumulator of claim 15, wherein the stepped surface comprises a first through hole to accommodate the first connection pipe and a second through hole to accommodate the second connection pipe.

17. The accumulator of claim 16, wherein the first through hole is positioned above a line that vertically bisects the stepped surface and the second through hole is positioned below a line that vertically bisects the stepped surface.

18. The accumulator of claim 12, wherein the first and second connection pipes each extend outward from a side surface of the case, and wherein the accumulator is configured so that in a state where the accumulator is coupled to the compressor, a side surface of the case is spaced apart from a facing side surface of the compressor by a distance that is less than a length of a portion of the first connection pipe or the second connection pipe that extends outward from the side surface of the compressor to the side surface of the case.

* * * * *